United States Patent [19]

Yoshida

[11] 4,123,827

[45] Nov. 7, 1978

[54] SLIDE FASTENER CHAIN

[75] Inventor: Hiroshi Yoshida, Uozu, Japan

[73] Assignee: Yoshida Kogyo K.K., Japan

[21] Appl. No.: 819,249

[22] Filed: Jul. 27, 1977

[51] Int. Cl.[2] ..... A44B 19/00; A44B 19/36

[52] U.S. Cl. ..... 24/205 R; 24/205.11 F

[58] Field of Search ..... 24/205.11 F, 205 R, 24/205.16 D

[56] References Cited

U.S. PATENT DOCUMENTS

| | | | |
|---|---|---|---|
| 3,001,904 | 9/1961 | Porepp | 24/205.11 F |
| 3,353,233 | 11/1967 | Frohlich | 24/205.11 F |
| 3,731,349 | 5/1973 | Terada | 24/205 R |

FOREIGN PATENT DOCUMENTS

| | | | |
|---|---|---|---|
| 7,137,952 | 7/1972 | Fed. Rep. of Germany | 24/205 R |
| 1,435,280 | 5/1976 | United Kingdom | 24/205.11 F |

*Primary Examiner*—Bernard A. Gelak

*Attorney, Agent, or Firm*—Bucknam and Archer

[57] ABSTRACT

A continuous or substantially endless length of slide fastener stringers is provided with jointing means for conjoining lengthwise individual unit lengths of stringers. The jointing means is analogous in cross-sectional configuration to an interlocking fastener element such that a slider member can move smoothly past jointing means during opening and closing of a pair of fastener stringers.

10 Claims, 15 Drawing Figures

SLIDE FASTENER CHAIN

BACKGROUND OF THE INVENTION

1. Field of the Invention

This invention relates to a slide fastener and more particularly to a pair of slide fastener stringers of substantially continuous or endless length.

2. Prior Art

It is the usual practice of slide fastener manufacturers to conjoin a multiplicity of predetermined individual unit lengths of fastener stringers to form extended, continuous lengths of such stringers which are conveniently referred to herein as "slide fastener chain" as contrasted individual slide fastener products, the resulting slide fastener chain being subsequently subjected to dying, parts assembling and other finishing operations.

One conventional way of conjoining or interconnecting discrete, adjoining lengths of stringers was to superpose their respective end portions one on the other and staple them together. Another alternative way known in the art was to lay adjoining stringers in the same plane with their respective ends held in confronting relation and sew or otherwise secure them together with use of an adhesive film. Such known conjoining procedures were disadvantageous in that the joints of unit stringers connected in a continuous row would often present an obstacle to the running of a slider along the stringers when tested for the opening and closing performance of the fastener chain. Therefore, it was necessary to discontinue the operation of the testing machine every so often in order to disconnect the joints of adjoining unit stringers to mount the slider. Further, the slide fastener chain to be used for fishing nets, which is manufactured by conjoining individual fastener lengths, has a further drawback in that the rows of fastener elements which have been coupled together on the respective stringer tapes are prone to become uncoupled or disengaged at and from where the joints are located when stresses are applied tending to split the stringers apart.

SUMMARY OF THE INVENTION

With a view to eliminating the forgoing difficulties of the prior art slide fastener chains, the present invention has for one of its objects to provide an improvement in a slide fastener chain wherein adjoining unit lengths of fastener stringers are interconnected by such jointing means which will permit sliders to run smoothly therethrough along the fastener element rows and which will also preclude accidental split-opening of the opposed stringers that have been coupled.

Briefly stated, there is provided in accordance with the invention a slide fastener chain comprising a multiplicity of pairs of predetermined unit length of slide fastener stringers, each stringer including a support tape and a row of interlocking fastener elements secured to an inner longitudinal edge of said tape, each of said elements having a coupling head and connecting portions, said stringers being disposed in the same plane with their respective adjoining ends confronting with each other across a gap space; and jointing means conjoining said unit length of stringers, said means comprising a thermoplastic slug generally conforming in cross-sectional profile to the contour of said fastener element and an adhesive reinforcing strip integral with said slug and extending substantially transversely of said support tape.

The above and other objects and features of the invention will be apparent from the following description taken in connection with the accompanying drawings which illustrate by way of example certain preferred embodiments which the invention may assume in practice.

BRIEF DESCRIPTION OF THE DRAWINGS

In the accompanying drawings.

Like reference characters refers to like parts throughout these various views.

DETAILED DESCRIPTION OF THE PREFERRED EMBODIMENTS

Figure 1:
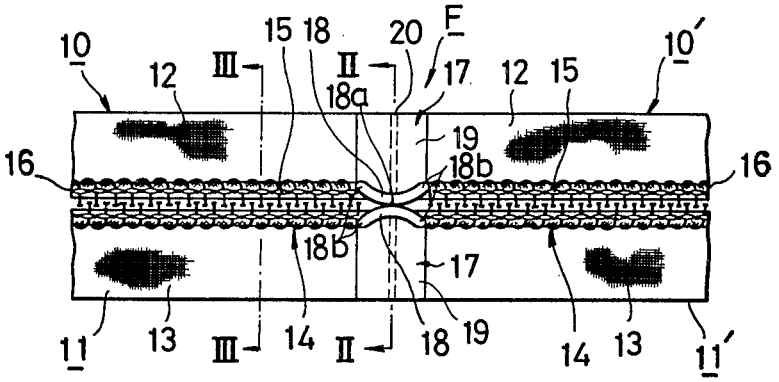
FIG. 1 is a plan view of a fragment of a length of slide fastener chain showing a jointing means connecting adjoining stringers end to end.

Referring now to the accompanying drawings and FIG. 1 in particular, there is shown a pair of slide fastener stringers 10,11 each of which comprises a support tape 12,(13) and a row of interlocking fastener elements 14 which is shown for purposes of illustration to be in the form of a continuous helical structure. The row of fastener elements 14 is secured, as by sewn stitches 15, to a longitudinal marginal edge 16 of each support tape 12,(13). The two oppositely disposed stringers 10, 11 are shown in FIG. 1 as in coupled or interengaged condition.

Longitudinally adjoining stringers 10,10' or 11,11' of a predetermined length are conjoined or interconnected by jointing means 17, in a manner hereinafter described, to form a continuous slide fastener chain F.

Figure 2:
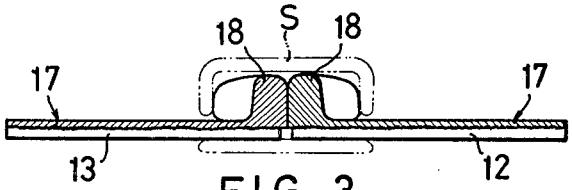
FIG. 2 is a sectional view taken on the lines II — II of FIG. 1.
Figure 3:
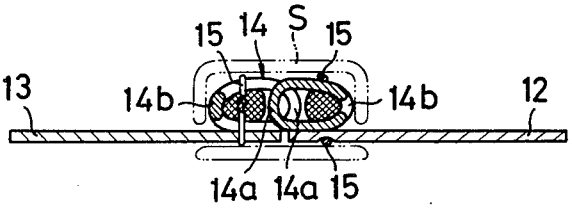
FIG. 3 is a sectional view taken on the lines III — III of FIG. 1.

The jointing means 17 which constitutes an important aspect of the present invention comprises a thermoplastic slug 18 generally conforming in cross-sectional profile to the contour of a coiled element 14 on each stringer 10,(11) as shown in FIGS. 2 and 3, and an adhesive reinforcing strip or film 19 integral with the slug 18 and extending substantially transversely of the support tape 12,(13). The thermoplastic slug 18 is generally banana-shaped or arcuate with its outwardly curved central periphery 18*a* extending towards and substantially flush with the coupling head 14*a* of the fastener element 14 and with each of its tapered ends 18*b* lying substantially in registry with the connecting portions or U-turns 14*b* of the fastener element 14. The reinforcing strip 19 covers over the full width of the pair of slide fastener stringers 10,11 and 10',11'. The jointing means 17 thus constructed provides for smooth reception therethrough and movement therealong of a slider S in a manner hereinafter described.

The jointing means 17 may be secured to the support tape 12,(13) by any known techniques, a preferred one of which is to injection-mold a thermoplastic material such as nylon or similar polymers to shape directly onto a portion 20 of the respective tape which is devoid of fastener elements 14. The jointing means 17 is thus secured in place spanning between adjoining stringers 10,10' or 11,11' which are disposed in the same plane with their respective ends confronting with each other. If desired, a gap space 21 may be provided between the respective confronting ends of the adjoining stringer 10,10' or 11,11'.

Figure 5:
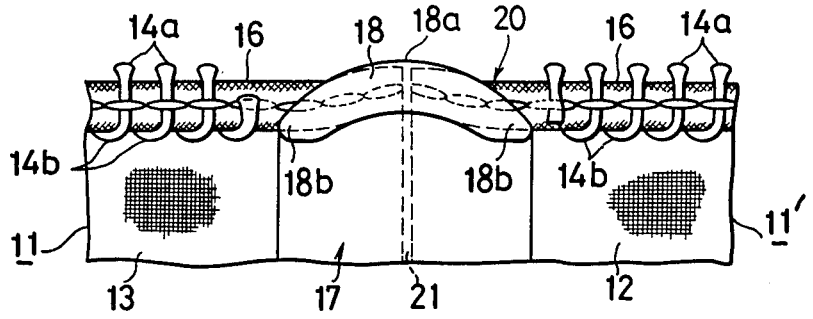
FIG. 5 is a plan view on enlarged scale of a fragment of one of a pair of fastener stringers showing one way of attaching a jointing means thereto.

FIG. 5 illustrates the jointing means 17 secured to the element-free portions 20 of adjoining stringers 11,11' with its tapered ends 18*b* positioned adjacent terminal elements 14 on the respective tape.

Figure 6:
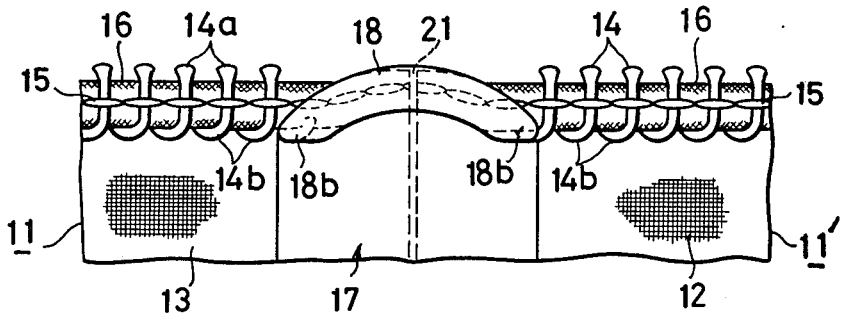
FIG. 6 is a view similar to FIG. 5 showing another way of attaching the jointing means.

FIG. 6 illustrates the jointing means 17 secured in place in a manner similar to FIG. 5 but with its tapered ends 18*b* each fused together with a portion of the fastener element 14.

Figure 7:
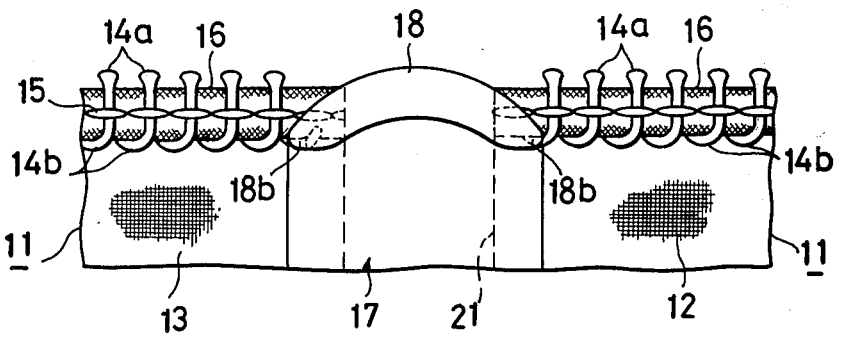
FIG. 7 is a view similar to FIGS. 5 and 6 but showing still another way of attaching the jointing means.

FIG. 7 illustrates the jointing means 17 secured in place in a manner similar to FIG. 6 but with greater gap space 21 resulting from the cutting away of defective portions of either of adjoining stringers 11,11'.

Figure 4:
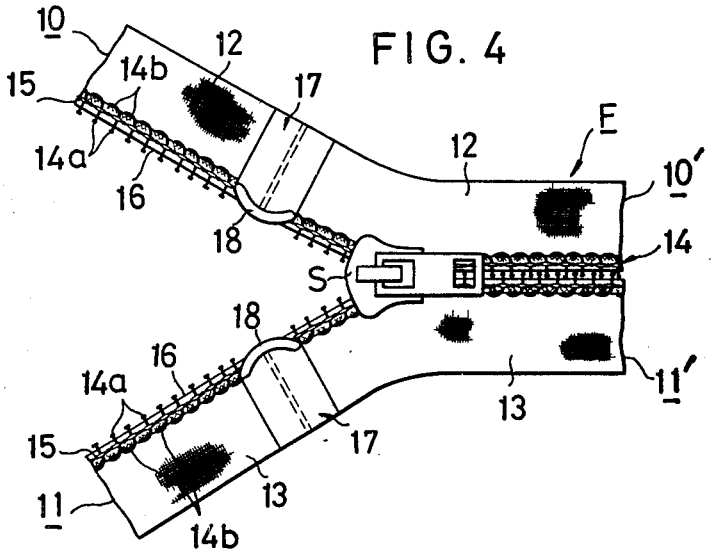
FIG. 4 is a plan view of a fragment of slide fastener chain showing two identical opposed stringers partly in disengaged disposition and partly interengaged by a slider.
Figure 8:
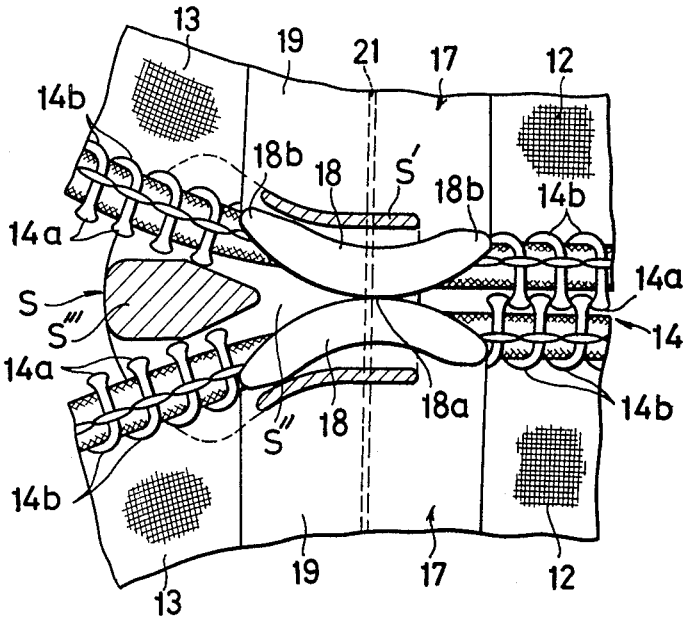
FIG. 8 is a plan view on enlarged scale of a fragment of slide fastener chain showing a slider passing though the jointing means.

When mounting sliders S on the slide fastener chain F consisting of a multiplicity of unit lengths of stringers 10,10' and 11,11' which have been conjoined in the manner above described, they are moved along the rows of fastener elements 14 in a direction to take the latter into coupling engagement in the well known manner as shown in FIG. 4. The slider S, upon approaching and passing the jointing means 17, brings the arcuate slug 18 on one joined stringer 10,10' resiliently into abutting engagement with that one the other or companion stringer 11,11' as flanged rails S' of the slider S guide the slugs 18 through channel S'' in very much the same fashion as they guide the rows of fastener elements 14 as shown in FIG. 8, the opposed arcuate slugs 18 being flarged in this position to avoid impinging contact with the diamond S''' of the slider S.

Figure 9:
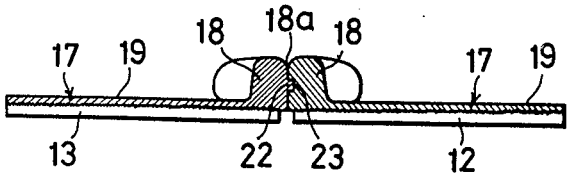
FIG. 9 is a sectional view of a slide fastener chain showing a modified form of jointing means.

There is shown in FIG. 9 a modification of jointing means 17 in which the slug 18 on one stringer is provided at its central periphery 18*a* with a projection 22 for engagement in a recess 23 formed in the corresponding peripheral portion of another slug 18 on the mating stringer, whereby the two cooperating slugs are securely coupled against separation when transverse stresses are applied to split apart the fastener chain.

Figure 10:
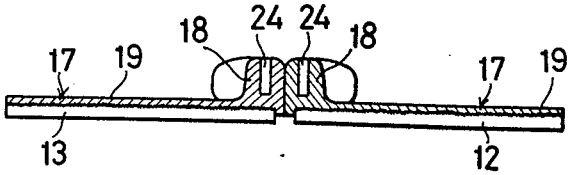
FIG. 10 is a sectional view of a slide fastener chain showing still another modification of jointing means.

FIG. 10 shows another modification of jointing means 17 wherein an elongate recess 24 is formed in the upper surface of the slug 18 with a view to imparting increased resiliency to the mass of the slug 18 and hence improving the passage of the slider therethrough.

Figure 11:
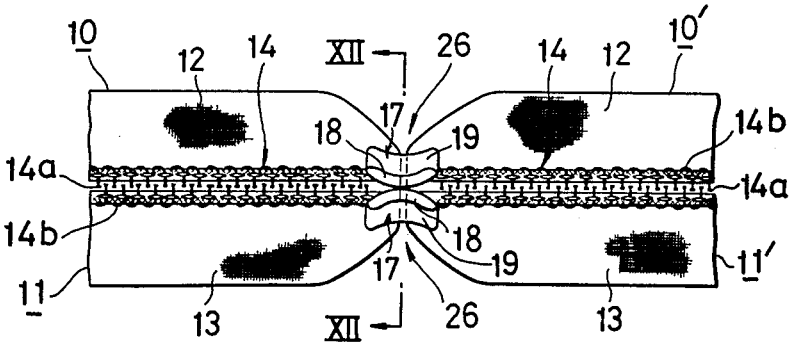
FIG. 11 is a plan view of a fragment of slide fastener chain showing another embodiment.
Figure 12:
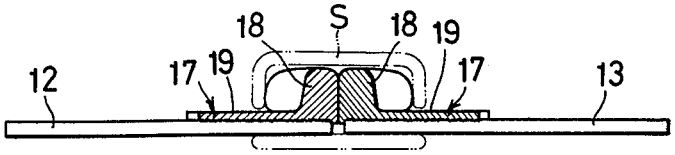
FIG. 12 is a sectional view taken on the lines XII — XII of FIG. 11.
Figure 13:
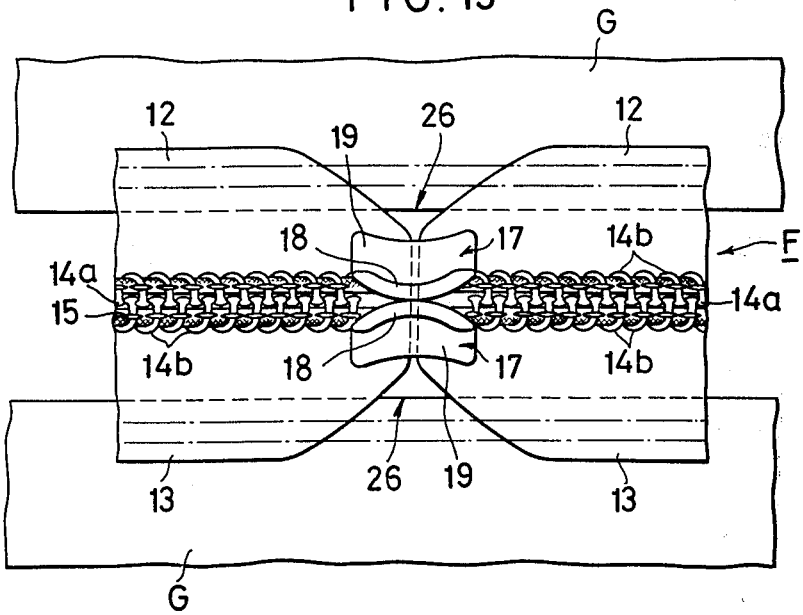
FIG. 13 is a plan view on enlarged scale of the slide fastener chain of FIG. 11 showing the same attached to a garment fabric.

FIGS. 11 through 13, inclusive, illustrate still another modification in which the jointing means 17 has an adhesive strip 25 integral with the arcuate slug 18, the strip 19 being reduced in width to about half the full width of the support tape 12,(13) with a view to facilitating sewing of the fastener chain F onto a garment G in the manner shown in FIG. 13. Another feature of this modification resides in the provision of a bay 26 at the sides of the junction of adjoining stringers 10,10' and 11,11' which is formed by tapering off the ends of the respective tapes as by means of a hot cutter. In the event that lateral pull is applied to the garment G, it will be directed, away from the jointing means 17, towards the rows of fastener elements 14 because the bay 26 extending in the region of jointing means 17 remains unsewn and hence free from the influence of lateral stresses. The embodiment described in connection with FIGS. 11,12 and 13 may be further modified to eliminate the tendency of the fastener chain F to split open or undergo separation of interlocked element rows by providing an elongated reinforcing strip 27 which is sewn or otherwise secured to the support tapes 12,13 to overlie the bay 26 closely adjacent the adhesive reinforcing film 19 of the jointing means 17, as shown in FIG. 14.

Figure 14:
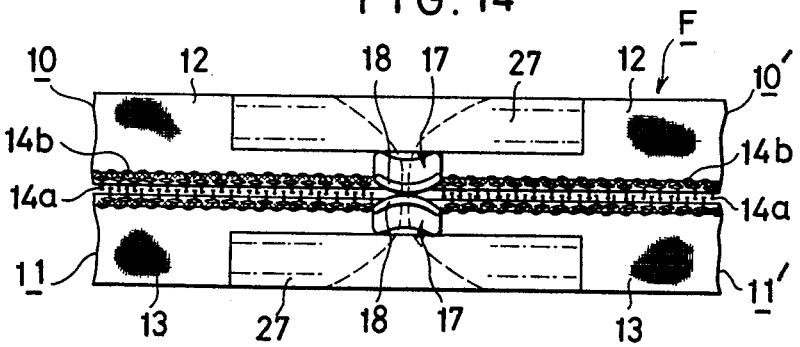
FIG. 14 is a view similar to FIG. 11 but showing the fastener chain carrying thereon a reinforcing strip.

In the embodiment shown in FIG. 14, the reinforcing strip 27 is secured to the support tapes 12,13 only at their portions outside of the jointing means 17.

Figure 15:
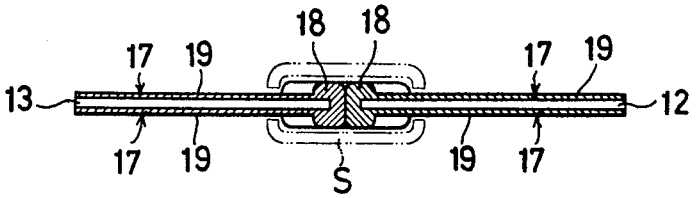
FIG. 15 is a sectional view of jointing means showing the same applied to a slide fastener chain having a meandering form of fastener elements.

FIG. 15 shows a further modification wherein the jointing means 17 is attached to the fastener chain F in sandwitched relation; namely, to extend symmetrically over both surfaces of the support tapes 12,13 in very much the same way as a meandering or zig-zag form of fastener elements is attached to the tapes.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A slide fastener chain comprising: a multiplicity of pairs of predetermined unit length of slide fastener stringers, each stringer including a support tape and a row of interlocking fastener elements secured to an inner longitudinal edge of said tape, each of said elements having a coupling head and connecting portions, said stringers being disposed in the same plane with their respective adjoining ends confronting with each other across a gap space; and jointing means conjoining said unit length of stringers, said means comprising a thermoplastic slug generally conforming in cross-sectional profile to the contour of said fastener element and an adhesive reinforcing strip integral with said slug and extending substantially transversely of said support tape, said thermoplastic slug being arcuately shaped with its outwardly curved central periphery extending towards and substantially flush with the coupling head of said fastener element and with each of its tapered ends lying substantially in registry with the connecting portions of said fastener element.

2. A slide fastener chain as defined in claim 1 wherein said thermoplastic slug on one stringer is provided at its central periphery with a projection for engagement in a recess formed in the corresponding peripheral portion of another slug on the mating stringer.

3. A slide fastener chain as defined in claim 1 wherein said thermoplastic slug has an elongate recess in the upper surface thereof.

4. A slide fastener chain as defined in claim 1 wherein the tapered ends of said slug are each fused together with a portion of the fastener element.

5. A slide fastener chain as defined in claim 1 wherein said adhesive reinforcing strip is reduced in width to about half the full width of the support tape.

6. A slide fastener chain as defined in claim 5 wherein the support tapes in each pair of adjoining stringers have their respective ends tapered off to form a bay extending transversely of said jointing means.

7. A slide fastener chain as defined in claim 6 wherein said support tapes each have an elongated reinforcing strip overlying said bay.

8. A slide fastener chain as defined is claim 1 wherein said jointing means is injection-molded to the fastener stringer.

9. In a slide fastener chain having a pair of longitudinally extending slide fasteners connected together endwise by a jointing means, each slide fastener including a pair of coextending stringer tapes to which are secured respective rows of interengageable fastener elements, said fastener elements having a predetermined cross-sectional profile transverse to the longitudinal axis of the corresponding slide fastener, the improvement which comprises jointing means having a pair of separate reinforcing strips, each reinforcing strip connected to and connecting together a respective set of two stringer tapes, one from each slide fastener, said two stringer tapes being in endwise alignment on a common side about said longitudinal axis; and a pair of bodies each integrally connected to a corresponding reinforcing strip and extending thereabove along said longitudinal axis, each body having a profile transverse to said longitudinal axis generally encompassed within the transverse profile of a corresponding row of fastener elements to allow passage of a given slider from the rows of fastener elements of one slide fastener over said bodies on to the rows of fastener elements of the other slide fastener, said bodies being disposed for abutting contact when the fastener elements of said slide fasteners are interengaged.

10. The improvement according to claim 9 wherein said bodies are made of thermoplastic material and are disposed for resilient abutting contact.

* * * * *